United States Patent [19]

Greten

[11] 3,978,250

[45] Aug. 31, 1976

[54] PROCESS AND APPARATUS FOR FORMING A LAYER FROM A MIXTURE OF PARTICLES HAVING VARIABLE PARTICLE SIZES

[75] Inventor: Berndt Greten, Springe, Germany

[73] Assignee: Bison-werke Bahre & Greten GmbH & Co. KG, Springe, Germany

[22] Filed: May 9, 1975

[21] Appl. No.: 576,022

[30] Foreign Application Priority Data

May 9, 1974 Germany ..... 2422487

[52] U.S. Cl. ..... 427/201; 118/309; 118/314; 118/DIG. 16; 427/212; 427/213

[51] Int. Cl.² ..... B05C 5/00

[58] Field of Search ..... 118/308, 309, 314, 24, 118/DIG. 1, DIG. 16; 239/654–655; 222/55, 190; 427/180, 201, 202, 203

[56] References Cited

UNITED STATES PATENTS

| | | | |
|---|---|---|---|
| 371,651 | 10/1887 | Wild | 118/309 |
| 1,068,915 | 7/1913 | Moore et al. | 118/309 |
| 2,822,024 | 2/1958 | Himmelheiber et al. | 222/55 X |
| 3,072,293 | 1/1963 | Greten | 222/55 |
| 3,478,969 | 11/1969 | Lund | 239/654 |
| 3,735,726 | 5/1973 | Butler | 118/24 |

*Primary Examiner*—Allen N. Knowles
*Assistant Examiner*—Hadd Lane
*Attorney, Agent, or Firm*—Craig & Antonelli

[57] ABSTRACT

An apparatus for forming a layer from a mixture of particles having variable particle sizes and including throwing rolls for casting the particulate mixture onto a flat support is further provided with a blower arranged to reverse the direction of horizontal movement of the particles as they fall onto the support by means of air flow.

33 Claims, 4 Drawing Figures

8
1
7
22
20
21
23
19
24
1
9
25
15

4'
3'
32
1'
6'
7'
8'
21'
31
30
39
33
37
2'
9'
-26-
35
27
34
28
36
29
11'
38

PROCESS AND APPARATUS FOR FORMING A LAYER FROM A MIXTURE OF PARTICLES HAVING VARIABLE PARTICLE SIZES

The present invention relates to a process for improving the separating or sifting effect realized during the formation of a layer made up of unsorted, glue-covered, dust-like, extremely fine, fine, medium-coarse, and coarser components, preferably of a vegetable origin such as wood chips, fibers or the like by spreading or casting the components on a conveying device. More specifically, the present invention relates to a process and apparatus for casting or spreading such components onto a conveying device, such as a continuously moving conveyor belt or the like, by means of spaced-apart throwing or casting rolls or the like, drivable about horizontal axes and in the moving direction of the layer or oppositely to the moving direction of the layer, the components being thrown or cast in the zone of the apparatus located beneath and between the throwing rolls, throwing or casting being accomplished so that the coarser components are placed in the central portion of this zone.

Processes and devices of this type are conventional. See German Pat. No. 920,209. The components to be spread or cast are fed from one or more metering tanks to throwing rolls, of which there are at least two. If the thickness of the board to be manufactured exceeds a certain measure, more than two spreading stations, i.e., more than two throwing rolls, are provided. For example, a total of four throwing rolls may be used, two throwing rolls being arranged at a relatively small spacing from each other for spreading or casting one-half of the cake and the other two throwing rolls, spaced more remote from the former two, being provided for spreading the other half of the layer. It is also known to provide, between two throwing rolls, each of which corresponds to one spreading station, two additional spreading stations in order to separately feed a material for forming a central layer if the board to be produced is to have a relatively large thickness.

The spreading or casting of relatively large amounts of glue-covered components has become of ever increasing interest recently, especially since by the use of a prepress in front of a finishing press the pressing time as well as the idling time, i.e., the press cycle, can be substantially reduced. See German Utility Model No. 7,140,379. Such a prepress is fashioned as a stationary flat press arranged in the production line between a chip cake separating saw and a single-layer press and is operated in synchronization with the main press. The unsorted, glue-covered components are spread according to the air-sifting method. See German Pat. No. 1,061,059. In these air-sifting spreading chambers which include two spreading stations, a problem arises with regard to the air-sifting effect if a prepress with or without subsequent jet-blow treatment of the preforms is arranged downstream of the casting chamber or chambers to shorten the cycle time of the finishing press. For example, if the amount of chips to be fed to the spreading or casting stations of the spreading device per unit time rises by approximately 25%, the air streams serving for the air-sifting treatment cannot readily penetrate or support the material to be screened. The air-sifting effect thus is reduced with an increase in the quantity to be spread, even if the amount and velocity of the air-sifting currents are optimally designed.

SUMMARY OF THE INVENTION

The present invention is directed to the problem of improving the separating or sifting effect realized when spreading or casting a layer of unsorted components, especially if considerable quantities of unsorted, glue-covered particles must be spread per unit time, without having to increase the number of feed points for the spreading step. Thus, most preferably only two spreading stations are to be utilized, and yet a flawless sifting or separating of the spread components is to be conducted.

To solve this problem, the present invention provides that the components forming the layer are penetrated by a flow of air currents or streams having an air-sifting effect, the air currents or streams essentially reversing the travel direction (i.e., the horizontal travel direction) of the cast or strewn components as they fall. In other words, particles of a preferably vegetable origin are first throw-spread (i.e., cast or strewn) during layer formation for the manufacture of the boards, whereupon they enter the influential zone of sifting air streams as they fall. The throw-spreading step can be executed by throwing rolls supported outside or within the spreading chambers. The results are not only that the cast or spread material is more suitably distributed, but also that substantially higher throughput efficiencies are attainable, which heretofore could only be realized when more than two spreading stations were provided. Thus, the spreading effect is improved and can be controlled by varying the speed of rotation of the throwing rolls and changing the speed of the blower arranged in this system, and furthermore the result that in the core and intermediate layers certain proportions of finer particles are present to improve the transverse tensile strength and the flexural strength of the thus-produced boards is obtained. The cover layers are always free of coarser particles. Because of the fact that air sifting is preceded by a throw spreading or casting step, it is furthermore possible to maintain the amount and velocity of the air streams serving for air sifting at a relatively low value so that all extremely fine particles participate in the cake formation. Thus, there is practically no possibility for extremely fine particles to enter into the exhaust current at the end of the spreading chamber or chambers.

An apparatus for conducting the above process in accordance with the present invention includes conveying means, a spreading chamber provided above the conveying means, and rotatable throwing or casting rolls or the like above the spreading chamber. The throwing or casting rolls are spaced from each other about horizontal axes and are supported and drivable in such a manner that the unsorted components fed thereto in a metered fashion are moved from one throwing roll toward the other throwing roll. The inventive apparatus is further provided with at least one blower arranged in the spreading chamber or chambers and disposed between the throwing rolls underneath the plane defined by the throwing roll axes of rotation. In addition, the blower is arranged to emit air streams or currents in opposite directions, which air streams are exhausted, i.e., removed by suction. It is advantageous to arrange the exhaust points or ports for the air streams or currents which have penetrated the cast or strewn components at both ends of the spreading chamber or chambers in an upper portion thereof.

Although the blower is arranged in the spreading chamber in the aforementioned device, it is possible in accordance with the present invention, starting with the same known spreading or casting apparatus, to provide at least one inlet opening in the wall terminating the spreading chamber at the top and to further provide at least one outlet opening at each of the two ends of the spreading chamber, through which air currents can be moved by means of a blower. In this case, it is advantageous to locate the outlet or exhaust openings provided at the ends of the spreading chamber in a lower zone or portion of the spreading chamber. To attain improved flow relationships, it is furthermore expedient to connect two air-guiding ducts to the air inlet opening of the spreading chamber. Between these air-guiding ducts, at least one aperture can be provided which vents or feeds air to the space therebelow.

It is furthermore advantageous to subdivide the spreading chamber by baffles vertically disposed between the throw points of the throwing rolls or the like, which baffles extend essentially in the travel direction of the conveying device. At least some of the baffles should be fashioned to be adjustable and settable about respective vertical axes. Although it is generally sufficient to have the upper edges of the baffles extend underneath the throwing points of the throwing rolls or the like, it may be advantageous to arrange the upper edges of the baffles above the throw points of the throwing rolls or the like. The rotational speeds of the throwing rolls or the like and/or the speeds of the blower should be variable. Also, the amount of components fed to the throwing rolls can be changed by adjustable guide vanes mounted above respective throwing rolls or the like. It is also expedient to dispose a further adjustable guide vane above the plane defined by the axes of rotation of the throwing rolls or the like between these throwing rolls in the zone of each of the latter. The length of these guide vanes should be variable.

Thus, the present invention provides an apparatus for forming a layer from a mixture of particulate matter having variable particle sizes comprising a spreading chamber, a conveying device at least partially in the spreading chamber for supporting the layer, at least two opposed throwing members for throwing particulate matter fed thereto onto the portion of the conveying device in the spreading chamber, and means for generating air currents flowing through the spreading chamber for reversing the horizontal movement of the particulate matter falling through the spreading chamber onto the conveying device. In addition, the present invention further provides a process for improving the separating or sifting effect realized during the formation of a layer made from a mixture of particulate components having variable particle sizes on a conveying device, wherein the components are cast or thrown onto said conveying device by means of spaced-apart throwing rolls or the like, drivable about horizontal axes, in the moving direction of the layer or oppositely to the moving direction of the layer, the components being cast or thrown in the zone located beneath and between the throwing rolls so that the coarser components are placed in the central portion of this zone, the components forming the layer being penetrated by air currents having an air-sifting effect and substantially reversing the direction of movement of the cast components as they fall.

BRIEF DESCRIPTION OF THE DRAWINGS

The present invention will be explained hereinbelow with reference to several schematically illustrated embodiments, in which.

DETAILED DESCRIPTION

Figure 1:
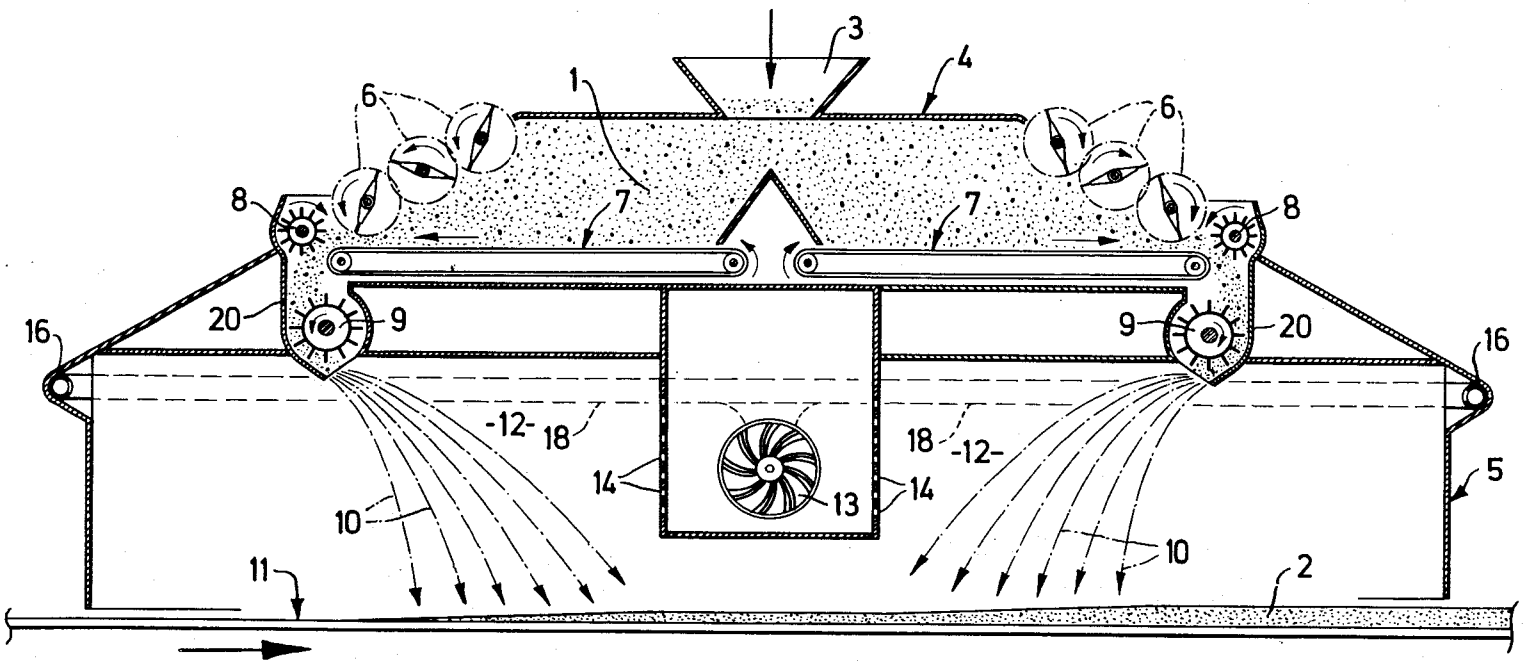
FIG. 1 is a lateral view of a spreading station according to the present invention and illustrates the spreading or casting of unsorted components by means of throwing or casting rolls only.

The unsorted, glue-covered components 1 which are to be spread to form a layer 2 are fed via a feeding hopper 3 to a metering tank 4 which supplies two spreading stations arranged in the upper zone of a spreading chamber 5. Levelling combs 6 effect dosing of the components 1 to be spread in cooperation with respective bottom belts 7. The components 1 are fed on each side of the apparatus by a loosening or delivery roller 8 to a throwing or casting roll 9. The latter moves the components along throwing parabolas or trajectories 10 so that the components are cast or deposited on conveying means 11. Finer and coarser components 1 then are located in the two cover layers of layer 2. The respective spreading range or spreading area of the components cast on conveying means 11 is relatively small.

Figure 2:
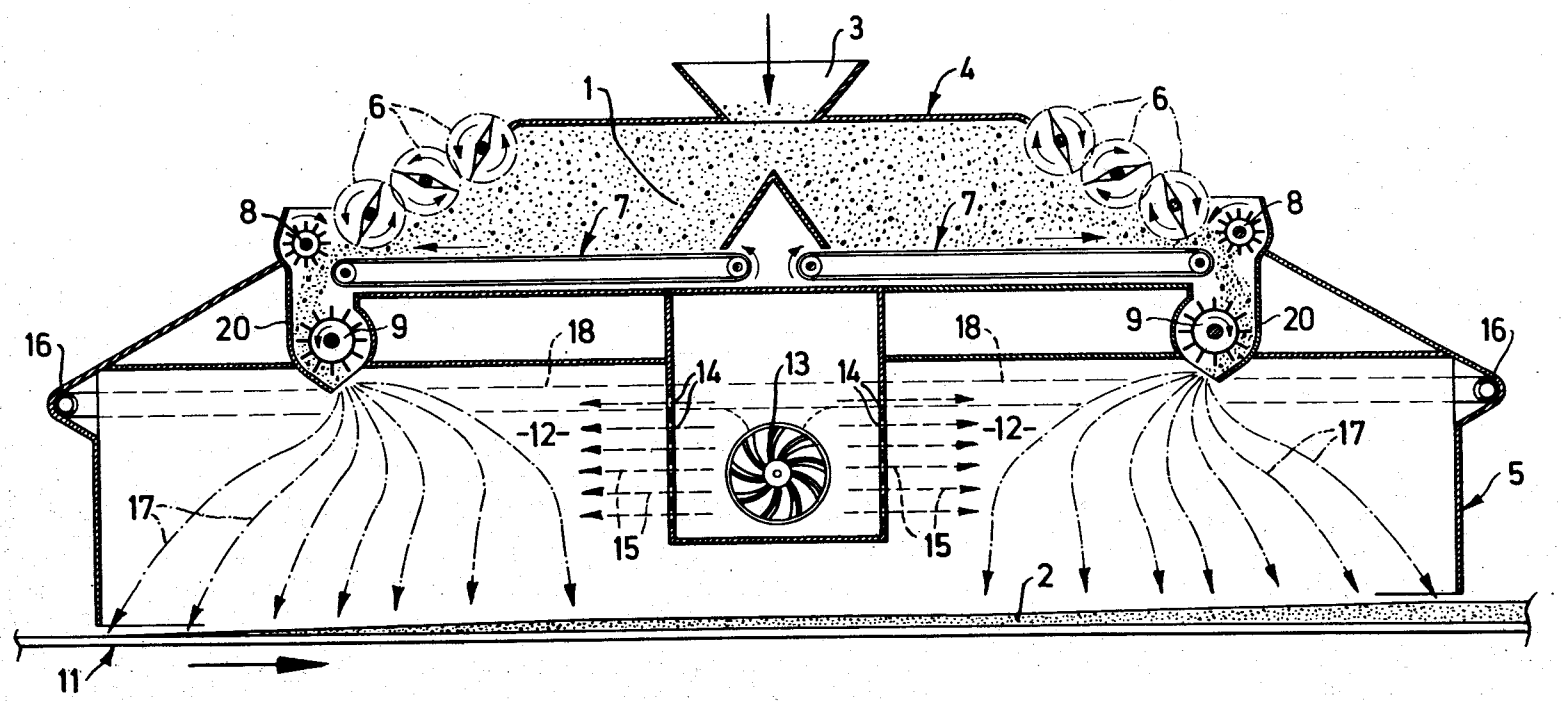
FIG. 2 illustrates the spreading station of FIG. 1 during the spreading of the components for cake formation by throw-spreading and air sifting, the blower of the spreading station being arranged in the spreading chamber.

According to the invention as shown in FIG. 2, at least one blower 13 is arranged in the space 12 of the spreading chamber 5 located between the throwing rolls 9 underneath the plane defined by the throwing roll axes of rotation. Blower 13 ejects air jets or streams 15 through openings 14 in opposite directions into spreading chamber 5, the air jets being exhausted. Exhaustion points or ports 16 are disposed, in this case, in the upper zone of the two ends of the spreading chamber. As can be found by comparing FIGS. 1 and 2, this has the result that the form of the throwing parabolas or trajectories 10 is changed, because the air jets 15 substantially reverse the travel directions of the components affected by the throw-spreading or casting step, as approximately indicated by curves 17. The exhausted air streams are fed back into the blower 13 via conduits 18.

Although the movement of coarser components is as a practical matter braked by air jets 15 acting thereon, the spread area of the components cast on conveying means 11 is larger than with throw-spreading alone. A graduated layer is thus obtained having a particularly broad dimension spectrum, i.e., a particularly wide distribution of particle sizes. While heretofore up to four spreading stations and/or four individual forming stations, for example, have been necessary for highest throughput efficiencies, the forming station as constructed in accordance with the invention is operable with two feed points. The spreading effect caused by the throwing rolls and the air screening are controllable independently of each other so that the composition of the components in the zone of curves 17 can be changed. The core and intermediate layers contain proportions of finer particles, whereby the transverse tensile strength and the flexural strength of the thus-produced boards are increased, as is well known. The outer cover layers are always free of coarser particles. As mentioned above, the amount and velocity of the air jets serving for the air screening step can be kept at a relatively low value, so that all extremely fine particles participate in the formation of the cake. Thus, there is no need to additionally feed particles via the blower.

Figure 3:
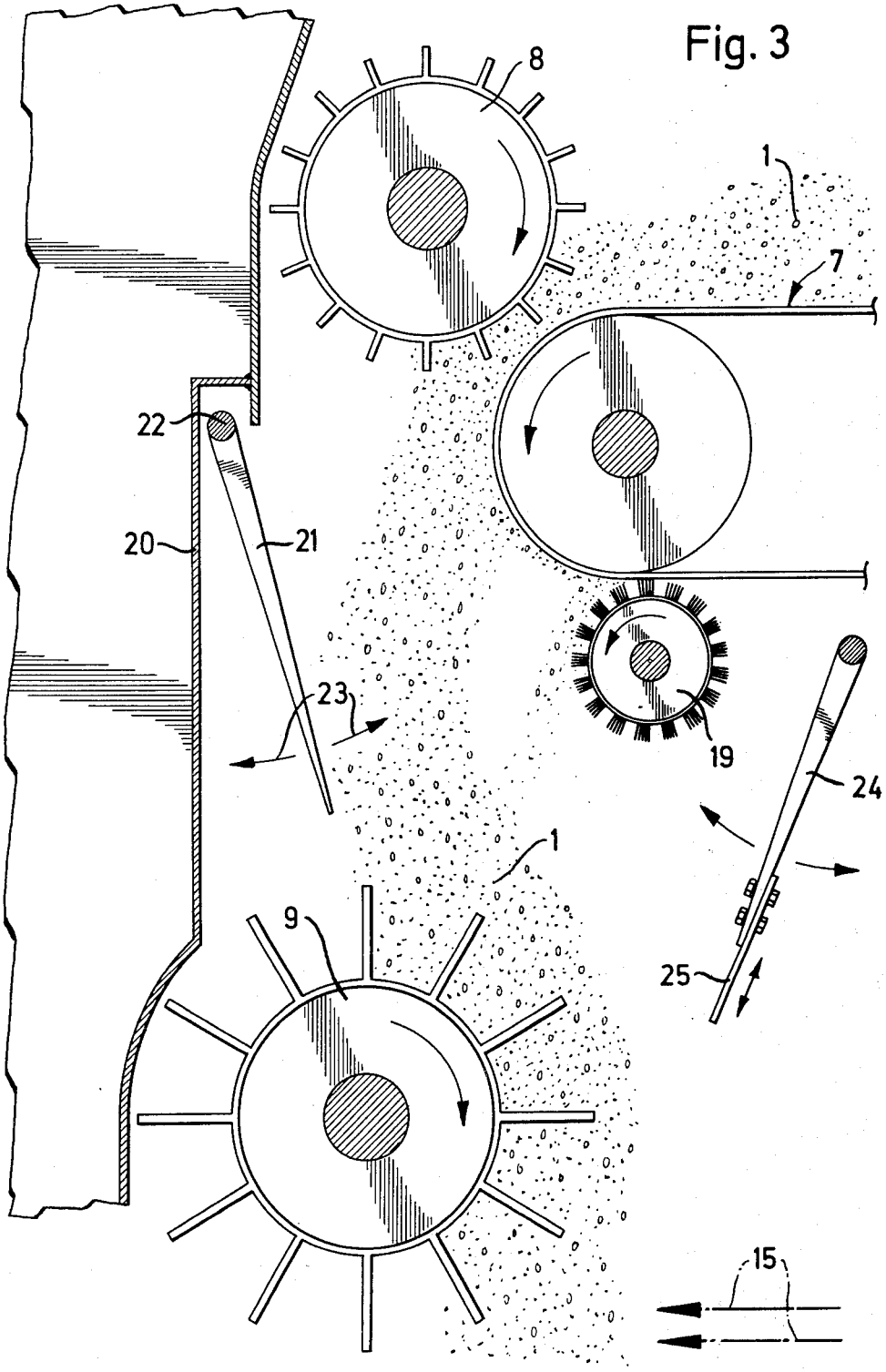
FIG. 3 is a lateral view of one of the spreading devices serving for the throw-spreading or casting step.

FIG. 3 shows that each bottom belt 7 is associated with a cleaning brush 19. A guide vane 21 and 22 is arranged, laterally offset, in the zone of each housing wall 20 underneath the loosening or delivery roller 8. These vanes are pivotable and fixable in position in the direction of arrows 23 so that the amount of components to be conducted to the throwing roll 9 can be regulated in accordance with predetermined requirements. Air currents or streams 15 move underneath roll 9. A likewise pivotable and fixable guide vane 24, provided with an adjustable end piece 25 limits the throw-spreading range between the vane and the throwing roll 9.

Figure 4:
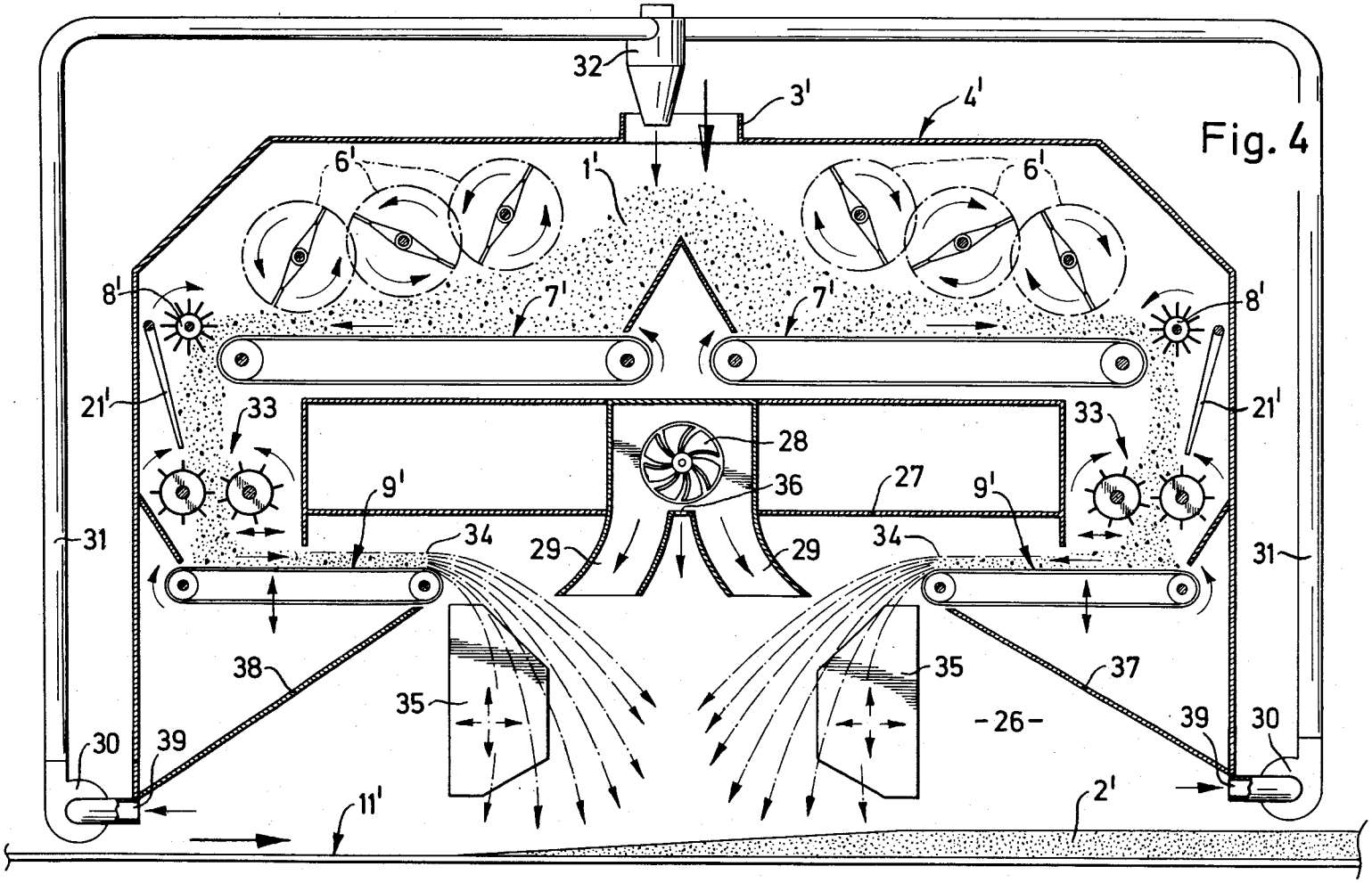
FIG. 4 is a lateral view of a spreading station wherein throwing belts are provided in place of throwing rolls and wherein the blower serving for the generation of the air currents is disposed outside of the spreading chamber.

The embodiment of FIG. 4 illustrates another feature of the present invention. Above wall 27 terminating the spreading chamber 26 at the top, a blower 28 is provided which injects air streams or currents in approximately opposite directions into the spreading chamber 26 by way of two air guiding ducts 29. To alter the direction of these air streams, exhaust blowers 30 are arranged in the lower zone of the two ends of the spreading chamber 26. Via respective conduits 31, these exhaust blowers are in communication with a separator 32 which feeds any entrained extremely fine particles to metering tank 4'. The parts associated therewith correspond to those of the embodiment of FIGS. 1 and 2 or FIG. 3, and these parts are provided with a primed reference numeral. In place of the throwing rolls 9, throw belts 9' are provided, and between the loosening roller or the like, denoted by 8', and the associated throw belt 9', spiked roller pairs 33 or the like are additionally arranged which effect a loosening of the thrown components. The distance between the two rollers of each roller pair is variable; they rotate in opposite directions, as indicated by arrows in FIG. 4. Also, the throw belts 9' are adjustably mounted as likewise shown by arrows. Vertically disposed baffles 35 extending essentially in the traveling direction of the conveying means 11' are located in the spreading chamber 26 in the zone underneath the two throw points 34 of the throw belts 9'. These baffles serve not only for the guidance of the thrown or cast components, but also for guiding the air currents. At least several of these baffles 35 can be adjustable about respective vertical axes. Alternately, they can be adjusted as indicated by the arrows. As shown in FIG. 4, the upper edges of the baffles 35 are disposed below throw points 34. However, these edges can also extend above throw points 34. The speed of rotation of throw belts 9' is variable as is the speed of the throw rolls 9. Similarly, the speed of blower 28 is also adjustable.

Also, as further shown in FIG. 4 at least one opening 36 is disposed between the two air guiding ducts, which serves to vent or feed air to the space located therebeneath. Moreover, the rear wall 37 and the front wall 38 are inclined to serve for the guidance of the air to the outlet or exhaust openings 39.

Although only a few specific embodiments of the present invention have been described above and illustrated in the drawings, it should be appreciated that many modifications can be made. All such modifications are intended to be included within the scope of the present invention which is to be limited only by the following claims.

What is claimed is:

1. A process for improving the separating or sifting effect realized during the formation of a layer made from a mixture of unsorted, glue-covered, dust-like, extremely fine, fine, medium-coarse, and coarser components, preferably of a vegetable origin such as wood chips, fibers, or the like on a conveying device, wherein the components are cast or thrown onto said conveying device by means of spaced-apart throwing rolls or the like, drivable about horizontal axes, in the moving direction of the layer or oppositely to the moving direction of the layer, the components being cast or thrown in the zone located beneath and between the throwing rolls so that the coarser components are placed in the central portion of this zone, the components forming the layer being penetrated by air currents having an air-sifting effect and substantially reversing the direction of horizontal movement of the cast components as they fall.

2. Apparatus for forming a layer from a mixture of particulate matter having variable particle sizes comprising a spreading chamber, a conveying device at least partially in said spreading chamber for supporting said layer, at least two opposed throwing members for throwing particulate matter fed thereto onto the portion of said conveying device in said spreading chamber, and means for generating air currents flowing through said spreading chamber for substantially reversing the horizontal movement of the particulate matter falling through said spreading chamber onto said conveying device.

3. The apparatus of claim 2, wherein said throwing members are arranged to cause spreading out of the particulate matter as said particulate matter falls onto said conveying device.

4. The apparatus of claim 3, wherein said generating means comprises at least one blower for emitting air currents in said spreading chamber and suction means for removing said air currents by suction.

5. The apparatus of claim 4, wherein each opposed throwing member is arranged to throw particulate matter towards the other, said at least one blower arranged to emit air currents from a source positioned between said opposed throwing members.

6. The apparatus of claim 5, wherein said at least one blower is arranged to blow air currents in opposite directions.

7. The apparatus of claim 5, wherein said at least one blower is mounted in said spreading chamber intermediate said opposed throwing members.

8. The apparatus of claim 7, wherein said suction means comprise exhaust ports located at both ends of the spreading chamber in an upper portion thereof.

9. The apparatus of claim 5, wherein said at least one blower is mounted above said spreading chamber.

10. The apparatus of claim 9, wherein said suction means comprise exhaust ports located at both ends of the spreading chamber in a lower portion thereof.

11. The apparatus of claim 9, further comprising air guiding ducts connected to said at least one blower to convey air from said at least one blower to said source.

12. The apparatus of claim 11, wherein at least two air guiding ducts are connected to said at least one blower, said at least two air ducts defining therebetween an aperture for feeding air to the space below said ducts.

13. The apparatus of claim 2, wherein said throwing members are throwing rolls mounted on horizontal axes, said apparatus further comprising drive means for driving said throwing rolls.

14. The apparatus of claim 13, further comprising vertically positioned baffles located in said spreading chamber between the throw points of the throwing members and extending essentially in the travel direction of said conveying device.

15. The apparatus of claim 14, wherein at least some of the baffles are adjustable and settable about respective vertical axes.

16. The apparatus of claim 14, wherein the upper edges of said baffles lie above the throw points of the throwing members.

17. The apparatus of claim 13, further comprising means for varying the speeds of rotation of said throwing members.

18. The apparatus of claim 13, further comprising means for varying the operating speed of said at least one blower.

19. The apparatus of claim 2, wherein said throwing members are endless belts mounted on horizontal axes, said apparatus further comprising drive means for driving said endless belts.

20. The apparatus of claim 19, further comprising vertically positioned baffles located in said spreading chamber between the throw points of the throwing members and extending essentially in the travel direction of said conveying device.

21. The apparatus of claim 20, wherein at least some of the baffles are adjustable and settable about respective vertical axes.

22. The apparatus of claim 20, wherein the upper edges of said baffles lie above the throw points of the throwing members.

23. The apparatus of claim 19, further comprising means for varying the speeds of rotation of said throwing members.

24. The apparatus of claim 19, further comprising means for varying the operating speed of said at least one blower.

25. The apparatus of claim 2, further comprising at least one first adjustable guide vane mounted above each throwing member for varying the amount of particulate material fed to the associated throwing member.

26. The apparatus of claim 25, further comprising at least one adjustable guide vane disposed above the plane defined by the axis of rotation of the throwing members and between said throwing members.

27. The apparatus of claim 26, wherein the length of said second guide vane is variable.

28. A process for improving the separating or sifting effect realized during the formation of a layer made from a mixture of particulate components having variable particle sizes on a conveying device, wherein the components are cast or thrown onto said conveying device by means of spaced-apart throwing rolls or the like, drivable about horizontal axes, in the moving direction of the layer or oppositely to the moving direction of the layer, the components being cast or thrown in the zone located beneath and between the throwing rolls so that the coarser components are placed in the central portion of this zone, the components forming the layer being penetrated by air currents having an air-sifting effect and substantially reversing the direction of horizontal movement of the cast components as they fall.

29. In a process forming a layer from a mixture of particulate matter having variable particle sizes in such a way that the size distribution of the particulate matter in the layer varies along the thickness of the layer with the outer surfaces of the layer containing particulate matter of finer particle size and the interior of the layer containing particulate matter of coarser particle size, said process including (a) casting said particulate matter onto a moving conveyor from at least two spaced casting means arranged so that the particulate matter from each casting means falls through a respective spreading chamber and then onto said moving conveyor, said moving conveyor arranged to pass under each casting means in series so that particulate matter from each casting means falls on the particulate matter on said moving conveyor cast by the previous casting means in said series, and (b) flowing air currents substantially horizontally through said respective spreading chambers to cause particulate matter of finer particle size to preferentially deposit on the outer surfaces of said layer and particulate matter of coarser particle size to preferentially deposit in the interior of said layer, the improvement for increasing the separating effect occurring when said air currents act on particulate matter in said respective spreading chambers comprising (1) casting said particulate matter from said casting means and into said respective chambers in such a way that substantially all of said particulate matter from each casting means moves in a respective first horizontal direction aligned with the motion direction of said conveyor as said particulate matter passes out of said respective casting means and (2) flowing air currents through the particulate matter falling in each respective spreading chamber in a second respective horizontal direction opposite to said respective first horizontal direction.

30. The process of claim 29, wherein said particulate matter is cast from only two casting means.

31. The process of claim 30, wherein said two casting means cast particulate matter towards one another.

32. The process of claim 31, further comprising guiding particulate matter as it falls through said respective spreading chambers and onto said conveyor by means of vertically positioned baffles located in said spreading chambers and extending essentially in the travel direction of said conveyor.

33. Apparatus for forming a layer of a mixture of particulate matter having variable particle sizes comprising:

a spreading chamber having upper and lower portions;

at least two opposed casting means for casting particulate matter into an upper portion of said spreading chamber, said casting means arranged to cast particulate matter toward one another;

a moving conveyor for receiving particulate matter falling through the lower portion of said spreading chamber, said conveyor arranged so that particulate matter from one of said casting means falls on the particulate matter on said conveyor cast by another of said casting means; and means for generating substantially horizontally flowing air currents in said spreading chamber, said air currents flowing in a direction opposite the movement of said particulate matter in the horizontal direction as said particulate matter is introduced into the upper portion of said separation chamber.

* * * * *